US009251762B2

(12) United States Patent
Johnson, III et al.

(10) Patent No.: US 9,251,762 B2
(45) Date of Patent: Feb. 2, 2016

(54) RUNTIME TRANSFORMATION OF IMAGES TO MATCH A USER INTERFACE THEME

(71) Applicant: Microsoft Corporation, Redmond, WA (US)

(72) Inventors: Matthew Johnson, III, Kirkland, WA (US); Jean Pierre Duplessis, Kirkland, WA (US); Arthur C. Leonard, Kirkland, WA (US); Weston Hutchins, Seattle, WA (US)

(73) Assignee: MICROSOFT TECHNOLOGY LICENSING, LLC., Redmond, WA (US)

( * ) Notice: Subject to any disclaimer, the term of this patent is extended or adjusted under 35 U.S.C. 154(b) by 182 days.

(21) Appl. No.: 13/719,275

(22) Filed: Dec. 19, 2012

(65) Prior Publication Data

US 2014/0168248 A1 Jun. 19, 2014

(51) Int. Cl.
*G09G 5/02* (2006.01)
*G09G 5/06* (2006.01)

(52) U.S. Cl.
CPC ..... *G09G 5/022* (2013.01); *G09G 5/026* (2013.01); *G09G 5/06* (2013.01); *G09G 2320/0233* (2013.01); *G09G 2320/0271* (2013.01); *G09G 2320/0626* (2013.01); *G09G 2340/06* (2013.01); *G09G 2354/00* (2013.01)

(58) Field of Classification Search
CPC ..... G09G 5/02; G09G 5/06; G09G 240/10; H04N 1/60; G06T 5/20; G06T 5/40; G06T 15/503; G06T 2207/20212; G06T 2207/20221; G06F 3/0484; G06F 17/3033; G06F 17/30097
See application file for complete search history.

(56) References Cited

U.S. PATENT DOCUMENTS

| | | | | |
|---|---|---|---|---|
| 5,854,620 | A * | 12/1998 | Mills et al. | 345/603 |
| 6,154,217 | A | 11/2000 | Aldrich | |
| 6,850,342 | B2 | 2/2005 | Woolfe et al. | |
| 7,176,919 | B2 | 2/2007 | Drebin et al. | |
| 8,237,990 | B2 | 8/2012 | Kulkarni et al. | |
| 8,698,833 | B2 * | 4/2014 | Anazawa | 345/589 |
| 2007/0245119 | A1 * | 10/2007 | Hoppe | 711/216 |
| 2010/0158357 | A1 | 6/2010 | Hung et al. | |
| 2011/0043535 | A1 | 2/2011 | Kwiatkowski et al. | |

OTHER PUBLICATIONS

Nayak, et al., "Self-Induced Color Correction for Skin Tracking Under Varying Illumination", Retrieved at <<http://dspace.library.iitb.ac.in/xmlui/bitstream/handle/10054/465/27938.pdf?sequence=2>>, in the proceedings of the International Conference on Image Processing, Sep. 14, 2003, pp. 4.

(Continued)

*Primary Examiner* — Antonio A Caschera
(74) *Attorney, Agent, or Firm* — Aneesh Mehta; Kate Drakos; Micky Minhas

(57) ABSTRACT

An application that generates a user interface includes multiple assets, such as icons, that are overlaid onto other user interface elements, such as tool bars, menus, windows, etc. The assets may be configured at runtime to match a user interface theme that utilizes specific colors, fonts, and styles. The application, at runtime, configures an asset to match the user interface theme by adjusting the luminosity of the pixels in the asset. A subset of pixels in the asset is matched to the color of a target background color by altering the luminosity of the subset of pixels in the asset to match the luminosity of the target background color. The luminosity of the remaining pixels is adjusted to match the theme.

20 Claims, 7 Drawing Sheets

(56) References Cited

OTHER PUBLICATIONS

Han, et al., "Automatic Illumination and Color Compensation Using Mean Shift and Sigma Filter", Retrieved at <<http://ieeexplore.ieee.org/stamp/stamp.jsp?tp=&arnumber=5278052, in the proceedings of IEEE Transactions on Consumer Electronics, vol. 55, Issue 3, Aug. 2009, pp. 9.

Ikedo, Tsuneo, "A Realtime Anti-Aliased Soft-Shadow Casting Renderer", Retrieved at <<http://ieeexplore.ieee.org/stamp/stamp.jsp?tp=&arnumber=5278052>>, https://cis.k.hosei.ac.jp/TR/HCIS-2002-01.pdf>>, Oct. 1, 2002, pp. 21.

* cited by examiner

RUNTIME TRANSFORMATION OF IMAGES TO MATCH A USER INTERFACE THEME

BACKGROUND

Software applications that interact with a user typically utilize a user interface. The design of the user interface is important since it serves as a bridge between the user and the application. A user's view of the application is based on the user's experience with the user interface. A good user interface should be easy to learn and use thereby providing the user with a positive experience. Most user interfaces are configured with assets, such as icons, buttons, graphic objects, menus, toolbars, dialog boxes, screens, windows, glyphs, etc. that are useful in making the user's interaction with the application a positive and productive experience.

A software application may generate different user interfaces for different uses. The application may employ a theme to generate a customized user interface. A theme specifies a style that includes specific colors, fonts, and graphics that are used in the user interface. A theme may be associated with the colors, fonts, and graphic objects that are employed by a particular organization or which suit a user's preference. An application may store assets pre-configured for each theme which may amount to thousands of assets. A large amount of assets increases the size of the application and the time needed to install the application in a user's computing device which makes the software application less viable for some users.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A software application interacts with a user through a user interface. The user interface may be configured at runtime to adhere to a particular theme. As such, assets used in the user interface are formatted at runtime to match the theme. In this manner, the software application does not need to store pre-configured assets that match the particular theme.

Certain assets are overlaid onto other user interface elements thereby necessitating an alteration in the coloring of the pixels in the assets to match the theme. The software application includes a runtime transformation module that alters the luminosity of the pixels in an asset to match a target background color associated with the coloring of a theme. An asset, such as an icon, may have its own background. The color of the asset's background is matched to a target background color of a user interface element on which the asset is overlaid. The coloring is facilitated by matching the luminosity of the asset's background to the luminosity of the target background. The luminosity of the remaining pixels in the icon is then adjusted to reflect the theme.

These and other features and advantages will be apparent from a reading of the following detailed description and a review of the associated drawings. It is to be understood that both the foregoing general description and the following detailed description are explanatory only and are not restrictive of aspects as claimed.

DETAILED DESCRIPTION

Figure 1:
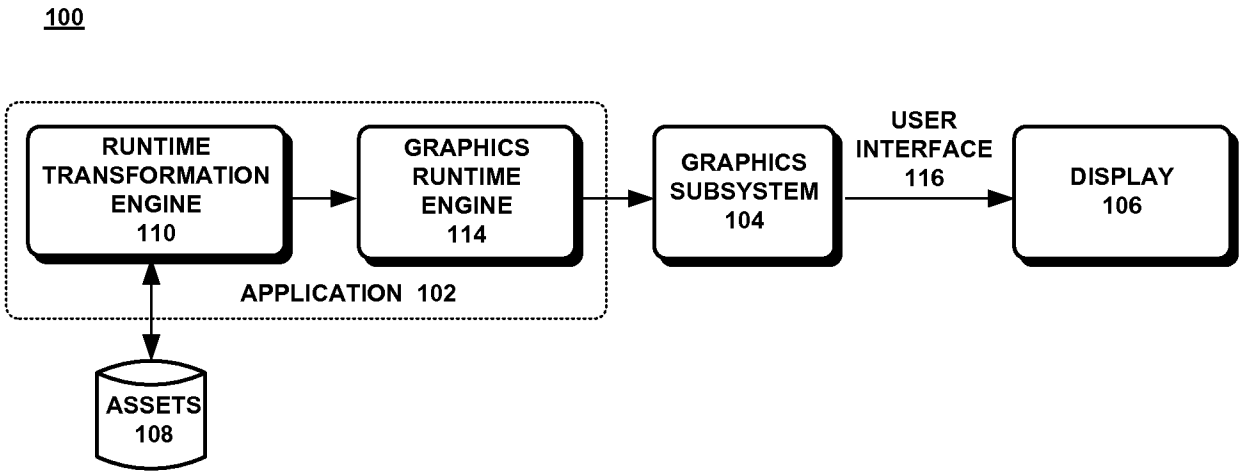
FIG. 1 is a block diagram illustrating an exemplary system providing a runtime transformation of images to match a user interface theme.

Various embodiments pertain to a technology that transforms assets at runtime to match a user interface theme. An asset, such as an icon, may be composed of its own background color. The background color of the asset is matched to a background color of a user interface element on which the asset is overlaid by matching the luminosity of the asset's background color to the luminosity of the target background. The target background may be the color of a user interface (UI) element, such as a toolbar, tool window, editor, drop-down menu, etc., onto which the asset is placed. The luminosity of the remaining pixels in the icon is adjusted to reflect the theme.

The embodiments allow a user to customize a user interface to their preference. Some users prefer a light text on a dark background since it is easier to read over longer periods of time and reduces eye strain when reading the screen for several hours. Other users prefer certain colors over other colors which have a more pleasing visual appearance for the user. The embodiments provide a capability to customize, at runtime, the user interface in a manner that suits the user's preference without storing pre-configured assets.

An asset may be represented by a bitmap having a plurality of pixels. A pixel is represented by pixel data values having three or four components. The first three components make up the red, green, and blue (RGB) components in a RGB color space. The fourth component is an alpha channel that indicates an opacity or transparency level for a pixel. The alpha channel controls the transparency of the red, green, and blue components in an asset.

An asset, such as an icon, may contain a halo. A halo is an outline of an additional color and/or pattern drawn around the periphery of the body of the icon. The halo may be of a predetermined thickness, such as a certain number of pixels, or a predetermined distance (e.g., $1/16^{th}$ of an inch, $1/8^{th}$ of an inch, etc.). The halo color and/or pattern may vary. The halo color may be darker near the outer edges of the icon and become lighter near the outer edges of the halo. At the outer edge of the halo, the color may be a lighter version of the same color. The variation of the halo color helps give the highlighted icon a glowing appearance. The glowing effect may be used in a user interface to make the icon appear activated when selected by a user.

However, the halo serves as the background color of the icon. When the icon is overlaid onto another graphic object, the background color of the icon then has to match the background color of the user interface element onto which the icon is placed in order for the icon to be appear aesthetically pleasing.

The alpha channel is typically used to seamlessly layer an image over any color background or another image. Without an alpha channel, images layered over another image would have jagged edges. The alpha channel is often used by an alpha blending technique to smooth out the jagged edges in an image. An alpha blending technique smoothes the jagged lines or textures by blending the color of an edge with the background color thereby producing a more pleasing and realistic appearance. However, without the alpha channel, the image may appear aliased with jagged edges and textures.

When alpha blending is used, pixels in a foreground image that have a non-zero alpha value are displayed either in combination with those in a background image, or, in the case of total opacity of the foreground image, in place of these in a background image. The background image shows through un-obscured where any pixels in the icon image have an alpha value of zero.

The embodiments transform the assets without the use of an alpha channel Legacy graphic applications do not utilize an alpha channel and as such, some assets may be still formatted in a 24-bit bitmap image file without an alpha channel value. By performing the transformation without using an alpha channel, the application can support legacy assets in addition to bitmap image files utilizing alpha channel values.

Attention now turns to a discussion of a system that performs a runtime transformation of images to match a user interface. Turning to FIG. 1, there is shown a system 100 having at least an application 102, a graphics subsystem 104, a display 106, and assets 108. The application 102 may include a runtime transformation engine 110 and a graphics runtime engine 114. Although the system 100 as shown in FIG. 1 has a limited number of elements in a certain topology, it may be appreciated that the system 100 may include more or less elements in alternate topologies as desired for a given implementation.

The application 102 may be any sequence of processor-executable instructions that generates a user interface. The application 102 may be a graphics software application, a 3D modeling application, a computer-aided design (CAD) tool, an integrated development environment (IDE), a 3D printing application, a graphics application for a 3D printer, a 3D gaming application, a web browser, an operating system, and so forth. In one or more embodiments, the application is Microsoft's Visual Studio®.

The assets 108 include graphic objects used in a user interface. The assets may include icons, buttons, graphic objects, menus, toolbars, dialog boxes, screens, windows, glyphs, and so forth. An asset may be implemented as a bitmap image. A bitmap is a file format that stores pixels in a grid. Common bitmap file formats include .bmp, .gif, .jpeg, .jpg, .png, .tiff, and .psd.

The runtime transformation engine 110 may perform the asset transformation at various time points within the execution of an application. The asset transformation may be performed at system initialization, when the user initiates a particular application (e.g., Visual Studio, etc.), or at any other time upon demand by the user.

The runtime transformation engine 110 performs the transformation of an asset in accordance with user-specified parameters. The runtime transformation engine 110 may receive a template of the asset and parameters for use in performing the transformation. The runtime transformation engine 110 then generates a new bitmap which is then used by the graphic runtime engine 114 to compose a digital image of the user interface 116. The graphics subsystem 104 renders the digital images in the user interface 116 onto a display 106. The graphics subsystem 104 may contain one or more graphics processing units (GPU) and a graphics memory dedicated to performing the rendering process.

In one or more embodiments, the runtime transformation engine 110 and the graphics runtime engine 114 may be a sequence of computer program instructions, that when executed by a processor, causes the processor to perform methods and/or operations in accordance with a prescribed task. The runtime transformation engine 110 and the graphics runtime engine 114 may be implemented as program code, programs, procedures, module, code segments, program stacks, middleware, firmware, methods, routines, and so on. The executable computer program instructions may be implemented according to a predefined computer language, manner or syntax, for instructing a computer to perform a certain function. The instructions may be implemented using any suitable high-level, low-level, object-oriented, visual, compiled and/or interpreted programming language.

In various embodiments, the systems 100, 200 described herein may comprise a computer-implemented system having multiple elements, programs, procedures, modules, such as without limitation, a mobile device, a personal digital assistant, a mobile computing device, a smart phone, a cellular telephone, a handheld computer, a server, a server array or server farm, a web server, a network server, an Internet server, a tablet, a work station, a mini-computer, a mainframe computer, a supercomputer, a network appliance, a web appliance, a distributed computing system, multiprocessor systems, or combination thereof. The elements of the system may be implemented in hardware, a combination of hardware and software, or software. For example, an element may be implemented as a process running on a processor, a hard disk drive, multiple storage drives (of optical and/or magnetic storage medium), an object, an executable, a thread of execution, a program, and/or a computer. One or more elements may reside within a process and/or thread of execution, and an element may be localized on one computer and/or distributed between two or more computers as desired for a given implementation. The embodiments are not limited in this manner.

Figure 2:
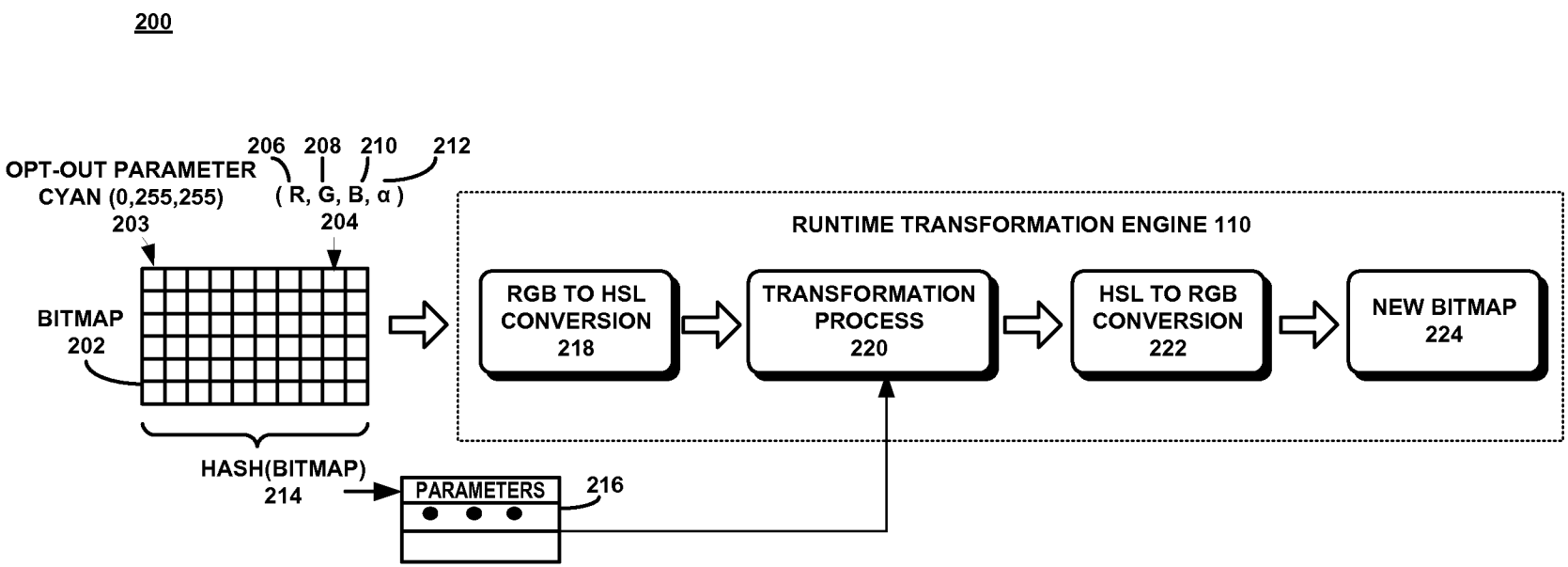
FIG. 2 is a block diagram illustrating exemplary components of the runtime transformation engine.

FIG. 2 is a block diagram further illustrating the runtime transformation engine 110. The runtime transformation engine 110 receives a bitmap 202 representing an asset. The bitmap 202 consists of a plurality of pixels arranged as a two-dimensional grid. A bitmap 202 may be represented in the red-green-blue (RGB) color space. In the RGB color space, each pixel in the bitmap has at least three color components. The first color component represents an intensity of red (R), the second color component represents an intensity of green (G), and the third color component represents an intensity of blue (B). Additionally, an alpha channel component 212 may be present. As shown in FIG. 2, pixel 204 has an associated RGB value with four such components 206, 208, 210, 212.

However, the color values in a bitmap are fixed. In order to change the color of an image, a transformation is applied to the pixels in the image resulting in a new bitmap. However, a naïve transformation of the colors in the bitmap may produce visual artifacts resulting in a poor image. Instead, the embodiments apply a transformation process that artfully matches the initial and target colors.

The transformation process converts the bitmap in the RGB color space into the hue-saturation-luminance (HSL) color space (block 218). There are several well-known algorithms that may be used to perform this transformation and any one of them may be used. The HSL color space is well known in the relevant art. Each pixel in the HSL color space is represented by three components: a hue component (H); a saturation component (S); and a luminance component (L). The hue component indicates a basic color, the saturation component indicates the saturation of the color; and the luminance component indicates the brightness of the color.

After the bitmap is converted to the HSL color space, a transformation is performed on the luminance component of each pixel (block 220). The luminance component for a pixel is represented as a rational number between 0 and 1. The luminance component for each pixel may be altered based on a source luminance and a target luminance. If an alpha component is present, the alpha component is ignored.

After the transformation, the HSL image may be converted into an RGB image (block 222) in order to create a new bitmap (block 224). The conversion from the HSL color space to the RGB color space is well known and any of the well-known HSL to RGB conversion algorithms may be used.

Parameters used in the transformation process may be received at runtime. For example, one such parameter may be a parameter indicating not to perform the transformation. In some embodiments, this parameter may be embedded in the bitmap 202. For example, a predetermined pixel may be configured with a particular value which indicates to opt-out of the transformation. In some situations, an asset may not need to be transformed.

As shown in FIG. 2, pixel 203 may be configured with the color Cyan (0, 255, 255) indicating that the bitmap should not be altered. When the transformation process detects this value at the designated pixel location, it may render the pixel invisible or transparent, allowing a background image to show through, when rendering the image.

In other embodiments, the parameters for the transformation may be stored in a separate data structure 216, such as a lookup table, with access to the data structure being implemented through a hash of the bitmap 214. In some situations, it may not be possible or practical to add the runtime parameters into the bitmap's metadata. Instead, the bitmap may be used to generate a hash key that points to a location in a lookup table that contains the transformation parameters. A hash function takes a block of data and returns a fixed-size bit string referred to as a hash key or hash. In several embodiments, a cryptographic hash function may be used to generate the hash.

As shown in FIG. 2, a hash of the bitmap 214 may produce a hash key that is used to access a particular location in the lookup table that contains the parameters for the transformation. The parameters may include an opt-out indicator, a source luminosity, $L_1$, and a target luminosity, $L_2$. The source luminosity may be the luminosity of the asset's background (e.g., halo). The target luminosity may be the luminosity of the target background on which the asset is overlaid.

Figure 3:
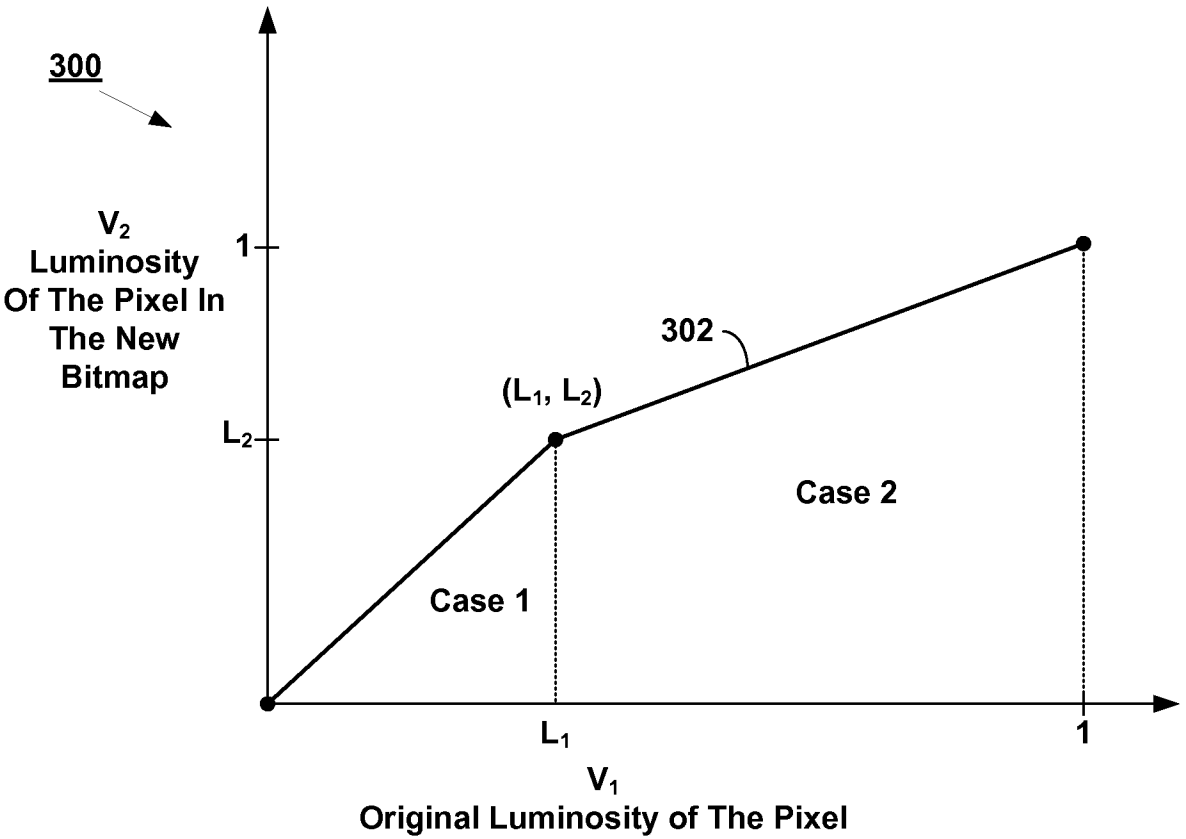
FIG. 3 is an exemplary graph illustrating the transformation for a light theme.
Figure 4:
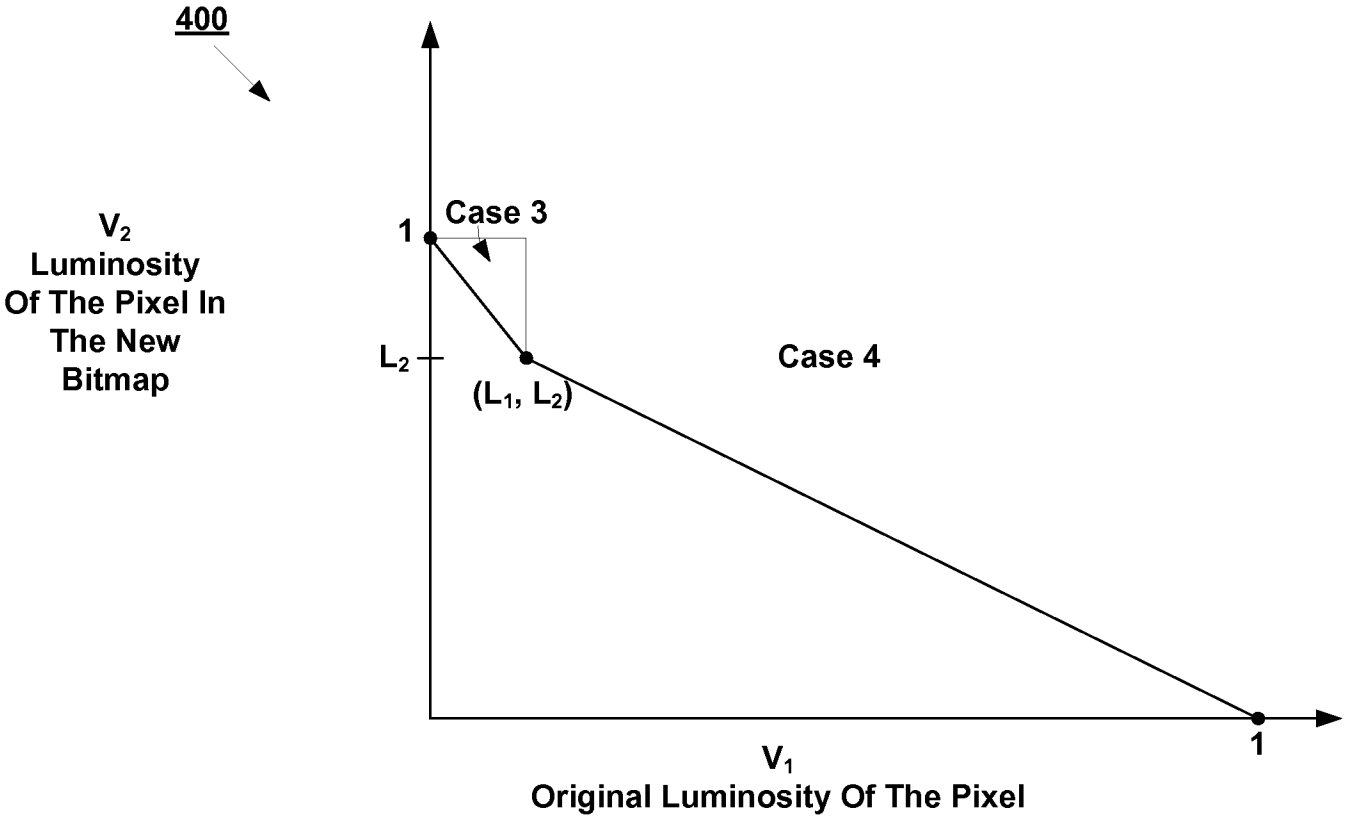
FIG. 4 is an exemplary graph illustrating the transformation for a dark theme.

Attention now turns to an exemplary illustration of the transformation process as applied to a dark and light theme. It should be noted that the illustrations shown in FIGS. 3 and 4 are exemplary and that the embodiments are not constrained to a dark and light theme. The transformation parameters may be set to specify other colors and the techniques described herein may be used for these colors as well.

During runtime, the transformation process modifies the luminosity of each pixel based on the source luminosity of the asset and the luminosity of the target background. The transformation process matches the luminosity of the pixels having the source luminosity value with the luminosity of the target background value. In this manner, the asset's background color matches the target background's color so that the outline of the icon disappears without performing alpha blending. For a dark theme, the luminosity of the remaining pixels is inverted so that dark areas of the original icon are light and light areas of the original icon are dark. For a light theme, the luminosity of the remaining pixels is altered to match the luminosity of the light theme.

The transformation process may be considered a linear function of the source luminosity, $L_1$, the luminosity of the target background, $L_2$, and the luminosity of the pixel before the transformation, $V_1$. The luminosity values $L_1$, $L_2$, $V_1$, and $V_2$ are rational numbers between 0 and 1.

FIG. 3 illustrates the transformation for a light theme. A light theme is identified by a target luminosity value less than 0.5. Referring to FIG. 3, there is shown a graph 300 representing the transformation process as a mapping of the luminosity of a pixel to a new luminosity value using curve 302. As shown in FIG. 3, the x-axis of the graph represents the luminosity of a pixel before the transformation, $V_1$, and the y-axis of the graph represents the transformed value, $V_2$. The point ($L_1$, $L_2$) on the graph represents the point where the source luminosity and the luminosity of the target background are the same (i.e., $L_1=L_2$). Pixels whose luminosities are lighter than the source luminosity are transformed using the equation found in case 1 and pixels whose luminosities are darker than the source luminosity are transformed using the equation found in case 2.

For Case 1, the luminosity of the pixel is transformed in accordance with the following equation:

$$V_2 = \frac{(L_2 - 1) * V_1}{L_1} + 1,$$

where $L_1$ is the source luminosity, $L_2$ is the luminosity of the target background, $V_1$ is the luminosity of the original pixel, and $V_2$ is the new value for the luminosity of the pixel.

For Case 2, the luminosity of the pixel is transformed in accordance with the following equation:

$$V_2 = \frac{(V_1 - 1) * L_2}{L_1 - 1},$$

where $L_1$ is the source luminosity, $L_2$ is the luminosity of the target background, $V_1$ is the luminosity of the original pixel, and $V_2$ is the new value for the luminosity of the pixel.

FIG. 4 illustrates the transformation for the case of a dark target theme. A dark theme is identified by a target luminosity value that is equal to or greater than 0.5 Referring to FIG. 4, there is shown a graph 400 representing the transformation process as a mapping where the transformed luminosity values of each pixel are found using the curve 402 shown in FIG. 4.

As shown in FIG. 4, the x-axis of the graph represents the luminosity of a pixel before the transformation, $V_1$, and the y-axis of the graph represents the transformed value, $V_2$. The point ($L_1$, $L_2$) on the graph represents the point where the source luminosity and the target luminosity are the same (i.e., $L_1=L_2$).

Case 3 refers to the situation where the luminosity of the original pixel is lighter than the source luminosity. In this case, the luminosity of the original pixel is altered to be darker relative to the target luminosity. Case 4 refers to the situation where the luminosity of the original pixel is darker than the source luminosity. In this case, the luminosity of the original pixel is lighted relative to the target luminosity.

For Case 3, the luminosity of the pixel is transformed in accordance with the following equation:

$$V_2 = \frac{(L_2 * V_1)}{L_1},$$

where $L_1$ is the source luminosity, $L_2$ is the luminosity of the target background, $V_1$ is the luminosity of the original pixel, and $V_2$ is the new value for the luminosity of the pixel.

For Case 4, the luminosity of the pixel is transformed in accordance with the following equation:

$$V_2 = \frac{(1 - L_2) * (V_1 - 1)}{L_1} + 1,$$

where $L_1$ is the source luminosity, $L_2$ is the luminosity of the target background, $V_1$ is the luminosity of the original pixel, and $V_2$ is the new value for the luminosity of the pixel.

Attention now turns to a description of various exemplary methods. It may be appreciated that the representative methods do not necessarily have to be executed in the order presented, or in any particular order, unless otherwise indicated. Moreover, various activities described with respect to the methods can be executed in serial or parallel fashion, or any combination of serial and parallel operations. The methods can be implemented using one or more hardware elements and/or software elements of the described embodiments or alternative embodiments as desired for a given set of design and performance constraints. For example, the methods may be implemented as logic (e.g., computer program instructions) for execution by a logic device (e.g., a general-purpose or specific-purpose computer).

Figure 5:
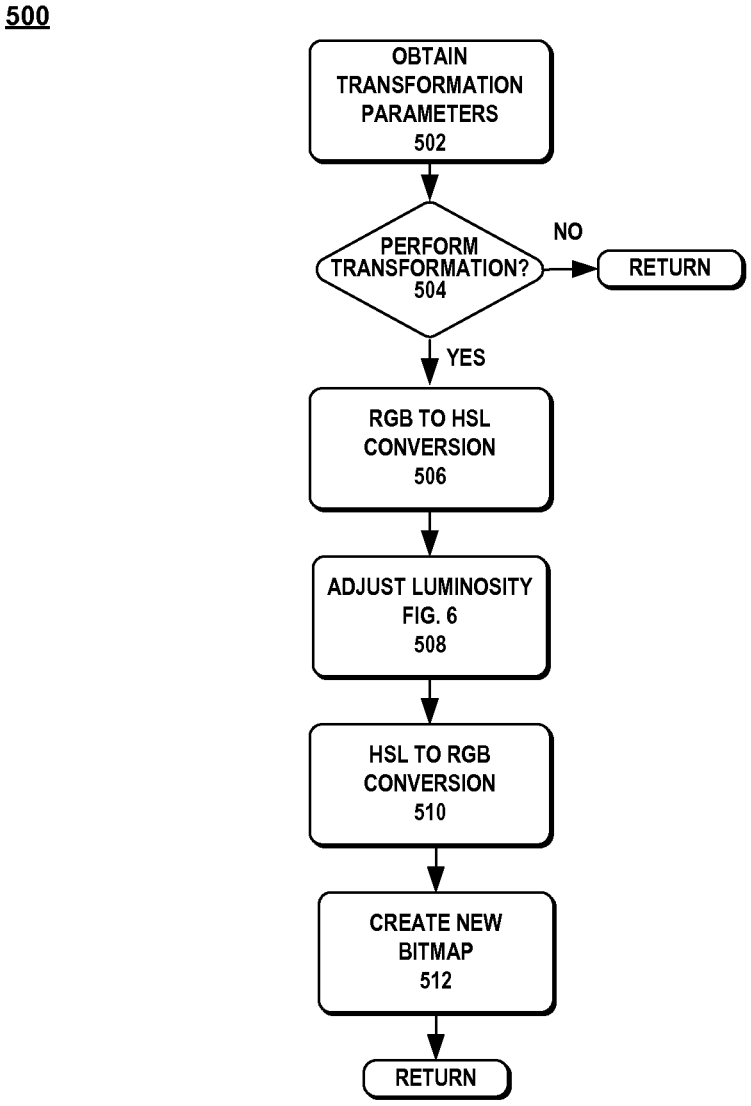
FIG. 5 is a flow diagram illustrating a first exemplary method.

FIG. 5 illustrates a flow diagram of an exemplary method 500 for a real-time transformation of an asset to match a user interface theme. It should be noted that the method 500 may be representative of some or all of the operations executed by one or more embodiments described herein and that the method can include more or less operations than that which is described in FIG. 5.

The runtime transformation engine may be initiated as part of another software application during the creation of a user interface. The runtime engine may initially obtain the transformation parameters (block 502). The transformation parameters may be embedded in the bitmap file of the asset or separately in a data structure, such as a lookup table. In the later case, the runtime transformation engine may hash the contents of the bitmap to obtain the location of the transformation parameters. The transformation parameters may include an opt-out parameter, the source luminosity, and the target luminosity.

The opt-out parameter is analyzed (block 504). If the opt-out parameter indicates that no transformation is needed (block 504-no), then the runtime transformation engine ceases processing the asset. Otherwise (block 504-yes), the runtime transformation engine performs the transformation. The bitmap file of the asset is read and the pixels are converted from a RGB color space to an HSL color space (block 506). The luminosity of the pixels is adjusted (block 508), the pixels are converted from the HSL color space to the RGB color space (block 510), and a new bitmap file is created (block 512). The process may be repeated for other assets used in the user interface.

Figure 6:
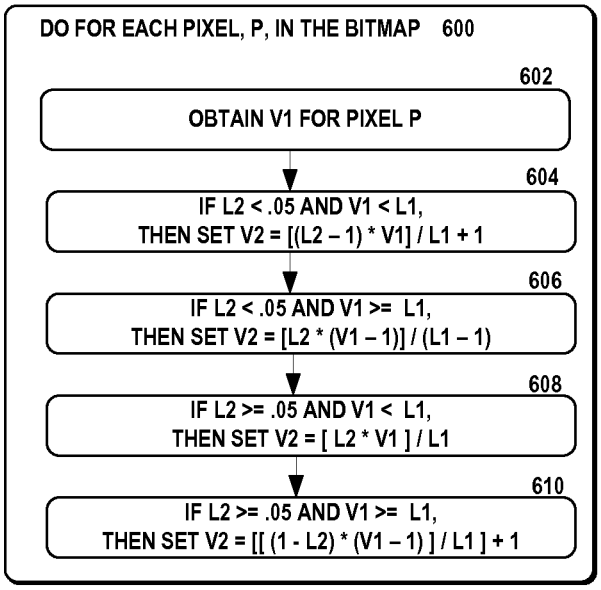
FIG. 6 is a flow diagram illustrating a second exemplary method.

FIG. 6 illustrates an exemplary transformation of an asset from an original theme to a light theme or dark theme. The runtime transformation engine processes each pixel, P, in the bitmap (block 600). The luminosity of a pixel, $V_1$, is read from the bitmap file (block 602). The luminosity of the pixel, $V_1$, is compared with the source luminosity, $L_1$, and the target luminosity $L_2$. If the target luminosity is a light theme ($L_2$<0.05) and the source luminosity is darker than the target luminosity ($V_1$<$L_1$), then the luminosity of the pixel, P, is altered as set forth in block 604 which is case 1 noted above. If the target luminosity is a light theme ($L_2$<0.05) and the source luminosity is equal to or lighter than the target luminosity ($V_1$<$L_1$), then the luminosity of the pixel, P, is altered as set forth in block 606 which is case 2 noted above.

If the target luminosity is a dark theme ($L_2$>=0.05) and the source luminosity is darker than the target luminosity ($V_1$<$L_1$), then the luminosity of the pixel, P, is altered as set forth in block 608 which is case 3 noted above. If the target luminosity is a dark theme ($L_2$>=0.05) and the source luminosity is equal to or lighter than the target luminosity ($V_1$<$L_1$), then the luminosity of the pixel, P, is altered as set forth in block 610 which is case 4 noted above.

Figure 7:
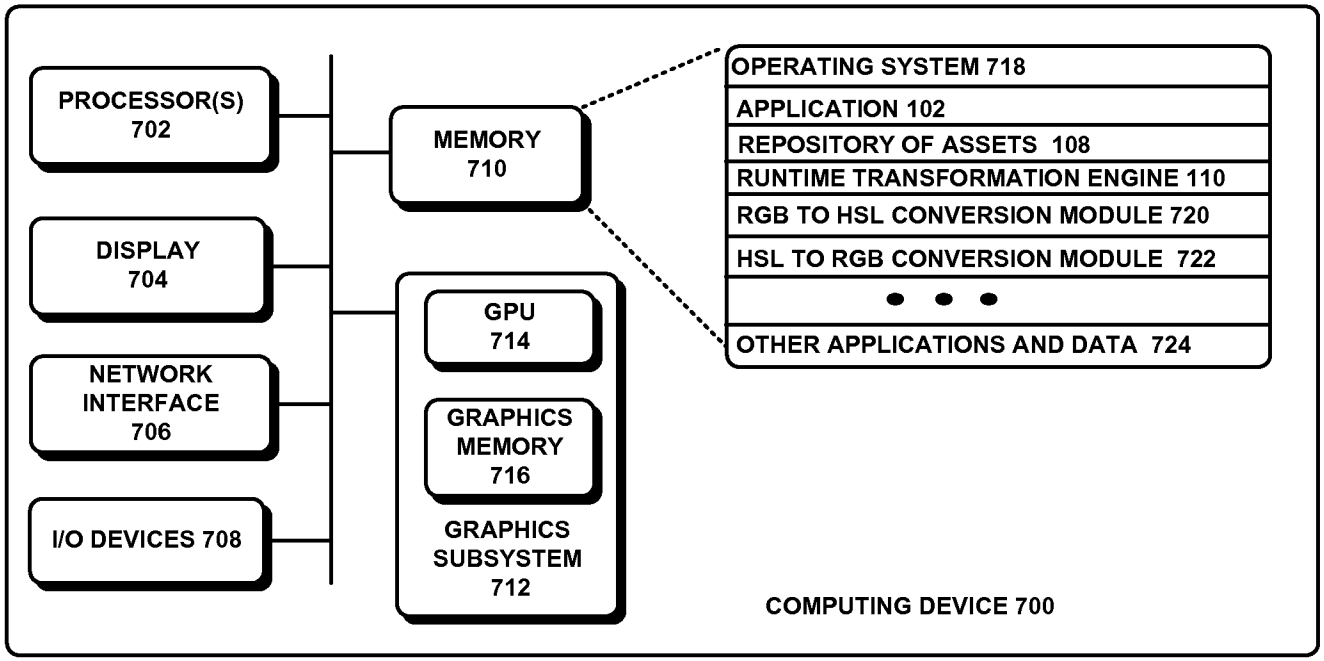
FIG. 7 is a block diagram illustrating an exemplary operating environment.

Attention now turns to a discussion of an exemplary operating environment. Referring now to FIG. 7, there is shown a schematic block diagram of an exemplary operating environment configured as a computing device 700. It should be noted that the operating environment is exemplary and is not intended to suggest any limitation as to the functionality of the embodiments.

The computing device 700 may be any type of electronic device capable of executing programmable instructions, such as without limitation, a mobile device, a personal digital assistant, a mobile computing device, a smart phone, a cellular telephone, a handheld computer, a tablet, a server, a server array or server farm, a web server, a network server, an Internet server, a work station, a mini-computer, a mainframe computer, a supercomputer, a network appliance, a web appliance, a distributed computing system, multiprocessor systems, or combination thereof.

The computing device 700 may have one or more processors 702, a display 704, a network interface 706, one or more input/output (I/O) devices 708, a memory 710, and a graphics subsystem 712. A processor 702 may be any commercially available processor and may include dual microprocessors and multi-processor architectures. The display 704 may be any visual display unit and it may be embedded within a computing device or physically separated from it. The display 704 may include a touch screen that receives a user's input through gestures, touches, etc. The network interface 706 facilitates wired or wireless communications between the computing device 700 and a communications framework. The I/O devices 708 may include any type of device capable of receiving input or providing output to a user, such as without limitation, a keyboard, mouse, microphone, voice recognition devices, pointing device, and the like. The graphics subsystem 712 is a specialized computing unit for rendering graphics images. The graphics subsystem 712 may be implemented as a graphics card, specialized graphics circuitry, and the like. The graphics subsystem 712 may include a graphics processing unit (GPU) 714 and a graphics memory 716.

The memory 710 may be any computer-readable storage media that may store executable procedures, applications, and data. The memory 710 may be implemented as a computer-readable storage device. The memory 710 may be any type of memory device (e.g., random access memory, read-only memory, etc.), magnetic storage, volatile storage, nonvolatile storage, optical storage, DVD, CD, floppy disk drive, flash drive, and the like. The computer-readable storage media does not pertain to propagated signals, such as modulated data signals transmitted through a carrier wave. The memory 710 may also include one or more external storage devices or remotely located storage devices. The memory 710 may contain instructions and data as follows:

an operating system 718;
an application 102;
a repository of assets 108;
a runtime transformation engine 110;
a RGB to HSL conversion module 720;
a HSL to RBG conversion module 722; and
various other applications and data 724.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A method implemented on at least one computing device having at least one processor and a memory, the method comprising:

obtaining a first bitmap representing an asset having a halo, the first bitmap having a plurality of pixels, each pixel of the plurality of pixels comprising a hue value, a saturation value, and a luminosity value, the halo including a first subset of the plurality of pixels associated with a source luminosity value, the first bitmap having a second subset of the pixels associated with a non-source luminosity value;

altering the luminosity value of at least one pixel of the first subset of the plurality of pixels having the source luminosity value to match a target luminosity value, wherein the target luminosity value associated with a background color of a graphic object on which the asset will be overlaid;

adjusting the luminosity value of at least one pixel in the second subset to a luminosity value that blends with the target luminosity value; and generating a second bitmap in a red green blue (RGB) color space having the altered luminosity values, the second bitmap for use in rendering a new image onto a display, wherein each step is performed by the at least one processor.

2. The method of claim 1, wherein the adjusting step further comprises:

when a requested theme is a dark theme, inverting the luminosity value of each pixel in the second subset.

3. The method of claim 1, further comprising:

converting the first bitmap from a RGB color space to a hue saturation luminance color space prior to obtaining the first bitmap.

4. The method of claim 1, wherein the target luminosity value is associated with a user specified theme.

5. The method of claim 1, further comprising:

receiving at runtime a source luminosity and a target luminosity.

6. The method of claim 1, wherein altering the luminosity value of at least one pixel of the first subset of the plurality of pixels and adjusting the luminosity value of at least one pixel in the second subset is performed during runtime.

7. The method of claim 1, further comprising:

obtaining at runtime a source luminosity and a target luminosity from a location specified by a hash of the bitmap.

8. A system, comprising:

at least one processor and at least one memory;

wherein the at least one memory comprising:

at least one asset including a halo, the at least one asset having a bitmap including a plurality of pixels, the halo including a first subset of pixels having a luminosity value matching a source luminosity, a second subset of pixels having a luminosity value that differs from the source luminosity; and wherein the at least one processor is configured to:

convert the luminosity values of the first subset of pixels to match a target luminosity value and generate a second bitmap including the converted luminosity values, the target luminosity value associated with a background color of a graphic object on which the at least one asset will be overlaid, wherein the bitmap is represented in a hue-saturation-luminance (HSL) color space and the second bitmap is represented in a red-green-blue (RGB) color space.

9. The system of claim 8, wherein the first subset of pixels is associated with a background color of the at least one asset.

10. The system of claim 8, wherein the bitmap includes an opt-out parameter, the opt-out parameter indicating not to convert the luminosity values.

11. The system of claim 8, wherein the bitmap includes runtime parameters used in the conversion.

12. The system of claim 8, wherein the at least one processor is further configured to: convert the luminosity values of the second set of pixels to blend in with the target luminosity value.

13. The system of claim 8, wherein each pixel of the plurality of pixels does not have an alpha channel value.

14. The system of claim 8, wherein the target luminosity value is associated with a user specified theme.

15. A device, comprising:

a processor; and an application having a user interface and a runtime transformation engine, the user interface having a plurality of user interface elements and icons, a first user interface element having an icon positioned thereon, the first user interface element having a target background color, the icon having a halo including a source background color, the source background color not having an alpha channel;

wherein the processor is configured to transforms the source background color to match the target background color by transforming a luminosity of pixels in the halo to match a target luminosity associated with the target background color, wherein the pixels in the icon are represented in a hue-saturation-luminance (HSL) color space.

16. The device of claim 15, wherein the at least one processor is further configured to:

transform the icon to match a target background color by inverting a luminosity value for a first subset of pixels.

17. The device of claim 15, wherein the at least one processor is further configured to: transform the icon to match a theme by blending luminosity values for a first subset of pixels to match the theme.

18. The device of claim 15, further comprising:

a table for storing a source luminosity and a target luminosity.

19. The device of claim 15, further comprising:

a table for storing an opt-out parameter indicating that no transformations are performed for an icon.

20. The device of claim 15, further comprising:

at least one dedicated pixel in the bitmap, the dedicated pixel for indicating an opt-out parameter.

* * * * *